United States Patent [19]

Ikeda et al.

[11] Patent Number: 4,787,764

[45] Date of Patent: Nov. 29, 1988

[54] SHEET FEEDER IN PRINTERS, HAVING AN IMPROVED OPERABILITY IN SHEET SETTING

[75] Inventors: Hiroshi Ikeda; Mikio Moriya, both of Tokorozawa, Japan

[73] Assignee: Citizen Watch Co., Ltd., Tokyo, Japan

[21] Appl. No.: 127,535

[22] Filed: Nov. 30, 1987

Related U.S. Application Data

[63] Continuation of Ser. No. 894,883, Aug. 8, 1986, abandoned.

[30] Foreign Application Priority Data

Aug. 17, 1985 [JP] Japan ..... 60-180058
Sep. 7, 1985 [JP] Japan ..... 60-196876

[51] Int. Cl.[4] ..... B41J 11/30; B41J 13/03

[52] U.S. Cl. ..... 400/616.2; 400/634; 400/639; 400/636

[58] Field of Search ..... 400/634, 636, 636.1, 400/636.2, 639, 639.1, 639.2, 616, 616.1, 616.2, 690.4, 693, 605; 226/74, 168

[56] References Cited

U.S. PATENT DOCUMENTS 1,213,189 1/1917 Hart ..... 400/636 X
2,517,147 8/1950 Vee ..... 400/636 X
4,340,315 7/1982 Teichmann et al. ..... 400/690.4
4,493,573 1/1985 Hashimoto et al. ..... 400/690.4 X

FOREIGN PATENT DOCUMENTS 73980 4/1984 Japan ..... 400/605

*Primary Examiner*—Charles Pearson
*Attorney, Agent, or Firm*—Lowe, Price, LeBlanc, Becker & Shur

[57] ABSTRACT

A printer, having a cylindrical platen rotatable for delivery of a printing sheet, which comprises a roller support shaft disposed in parallel with the platen and rotatably supported by a cover which is capable of being open and closed, and at least one feed roller mounted on the shaft. In the state the cover is closed, the cut form sheet is settable, without the need of displacing the feed roller, by frictionally holding the sheet at the side downstream of the printing section between the feed roller and urging portions formed on a printer main unit at a location close to the platen to delivery the sheet, with utilization of resiliency of the sheet, thereby permitting printing onto the sheet up to trailing or lower end thereof. In case of using the continuous sheet, a tractor unit is mounted on the printer. Upon mounting this unit, the feed roller is displaced away from its location for feeding the cut form sheet, so as not to prevent delivery of the continuous sheet to be fed from the platen to the tractor unit.

8 Claims, 7 Drawing Sheets

SHEET FEEDER IN PRINTERS, HAVING AN IMPROVED OPERABILITY IN SHEET SETTING

This application is a continuation of application Ser. No. 894,883, filed 8/8/86, now abandoned.

BACKGROUND OF THE INVENTION

The present invention relates to a printer and more particularly to a sheet feeder for use in printers, which is simple in operation for setting a printing sheet.

Printers of the type having a platen disposed at a location opposite a printing head, and frictional rollers disposed in urged contact with the platen at the upstream side in a sheet feed path of the printer with respect to the printing head are known. In these conventional printers. It is also known to provide therein a bail roller mechanism including bail rollers fastened to a shaft which is rotatably supported at its opposite ends by levers pivotally supported in a direction toward and away from the platen. The bail rollers are adapted to be in urged contact with the platen at the downstream side in the street feed path with respect to the printing head, so that a sheet is frictionally engaged between the platen and the friction rollers and between the platen and the bail rollers, to be fed along the sheet feed path by rotation of the platen. These bail rollers. located at the downstream side make it possible to continue the sheet feeding operation of the sheet even when and after the sheet has reached a location in the sheet feeding path where the trailing end thereof assumes a position downstream of the friction rollers at which the trailing end is disengaged from the platen, so that printing onto the sheet can be positively effected over the entire length of the sheet up to the trailing end thereof. In a printer of this kind, however, to set the sheet around the platen, it is necessary to displace the bail rollers in the direction away from the platen so as to release the urged contact with the platen. In case that the printer is so designed that the displacement of the bail rollers must be effected manually, a complicated operation therefor by the user is required, resulting in inconvenience to the user, whereas, if the printer is so arranged as to automatically displace the rollers by the use of a solenoid mechanism, etc., the printer becomes high in cost.

Further, in order to selectively use both of a cut form sheet and a continuous form sheet, it has been conventionally known to employ printers of the type having two kinds of upper covers each adapted to be detachably mounted on the main unit of the printer, where either one of them is selectively employed in dependence on the type of sheet to be used. Namely, an upper cover of the kind having the above-mentioned bail roller mechanism is mounted on the printer unit when the cut form sheet is to be fed, whereas another kind of upper cover having a tractor unit is mounted for feeding the continuous form sheet. In this manner, the conventional printers require plural covers having different arrangements from each other for feeding operation of both the types of sheet. This makes the printer costly, and makes the sheet setting operation of the printer complicated since the cover must be replaced each time the printing sheet is changed from the cut-form type to the continuous form type and vice versa.

SUMMARY OF THE INVENTION

It is an object of the invention to provide a sheet feeder for use in printers, which is simple in operation in setting a printing sheet and low in cost.

It is another object of the present invention to provide a sheet feeder in printers, which is capable of positively delivering a printing sheet even in a condition that the trailing end of the printing sheet has reached a sheet feeding position in the vicinity of a location opposite a printing section of the printer, so that a printing operation onto the printing sheet can be positively effected over the entire length of the sheet up to the trailing end thereof.

It is a further object of the present invention is to provide a sheet feeder capable of delivering a printing sheet of both of cut form and continuous form, without the need to replace component parts of the feeder depending on the type of printing sheet.

It is a still further object of the present invention is to provide a sheet feeder capable of suppressing noise generated upon printing.

According to the present invention, there is provided a sheet feeder for use in printers having a printing section. The sheet feeder comprises a platen disposed at a location opposite the printing section and adapted to be rotatively driven. At least one feed roller, which is rotatably supported and operatively connected to the platen through coupling means for rotation with rotation of the platen, is disposed at a location separate from the platen. Further, at least one urging means is provided for bringing a printing sheet into urged contact with the at least one feed roller. Since the feed roller is separated from the platen, the printing sheet is smoothly settable, without being blocked by the feed roller. The feed roller is caused to rotate with rotation of the platen, and the printing sheet brought into urged contact with the roller by the urging means is delivered with rotation of the feed roller.

DETAILED DESCRIPTION

Figure 1:
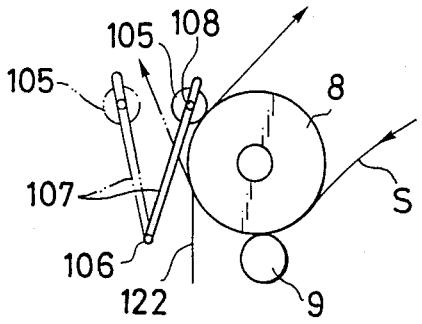
FIG. 1 PRIOR ART
FIG. 1 is a fragmentary side view showing a bail roller mechanism provided in a conventional printer.

FIG. 1 shows a conventional printer equipped with a bail roller mechanism, a platen 8 adapted to be rotatively driven, friction rollers 9, and a plate spring 122. These elements 9, 122 are disposed below a printing section (not shown) of the printer and in urged contact with a lower half outer periphery of the platen 8 so as to urge a printing sheet S against the platen. The bail roller mechanism includes bail rollers (one of which is shown by reference numeral 105) rotatably mounted on a shaft 108 which is carried at opposite ends thereof by levers (one of which is shown by 107) which are in turn pivotally supported by a support shaft 106. The printer is operable to effect printing onto the printing sheet S while the friction rollers 9 and the bail rollers 105 cooperate with the platen 8 so as to deliver the printing sheet S, with rotation of the platen 8. When the lower end of the sheet S passes the friction rollers 9, a lower end of the sheet S is separated from a location at which the sheet is held between the platen 8 and the friction rollers 9. However, the trailing end of the sheet is allowed to be pulled out up to its sheet feeding position near the printing head (not shown) under the bias of the spring plate 122 and the bail rollers 105, so that the printing onto the sheet S can be effected up to the trailing or lower end thereof. This reduces limitations in printing layout, and permits pagination at a lower end portion of the sheet S, for instance. However, upon setting the sheet S around the platen 8, it is required to pivot the levers 107 in a direction away from the platen 8 to disengage the bail rollers 105 from the platen 8 for insertion of the sheet therebetween since the rollers otherwise can block the insertion of the sheet S between itself and the platen 8, and then pivot the levers in a reverse direction to set the bail rollers in urged contact with the platen 8 again, with the sheet movably held therebetween. This arrangement has drawbacks such as complicated operation upon setting the sheet S and increased cost of the printer, as mentioned above.

FIGS. 2 through 5 show a printer equipped with a sheet feeder according to an embodiment of the present invention, in a state where the cut form sheet is feedable.

Figure 2:
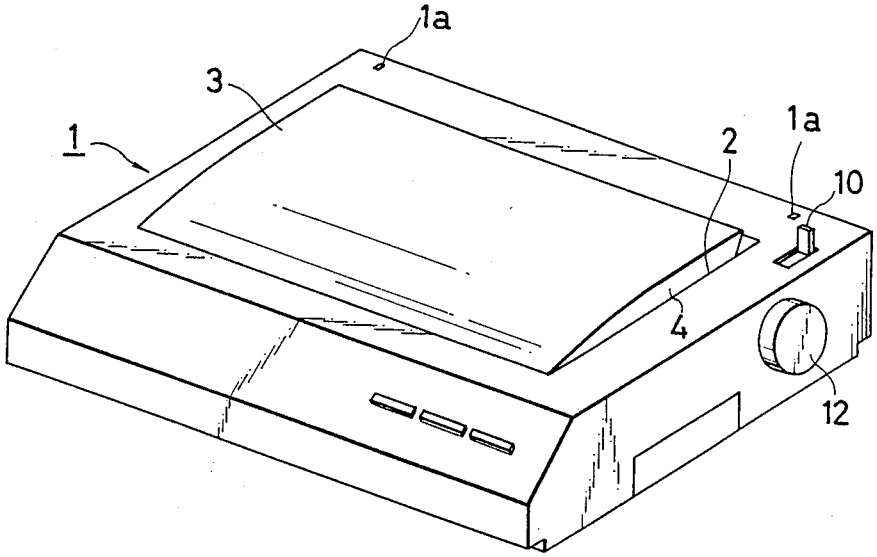
FIG. 2 is a schematic perspective view showing external appearance of a printer according to an embodiment of the present invention.
Figure 3:
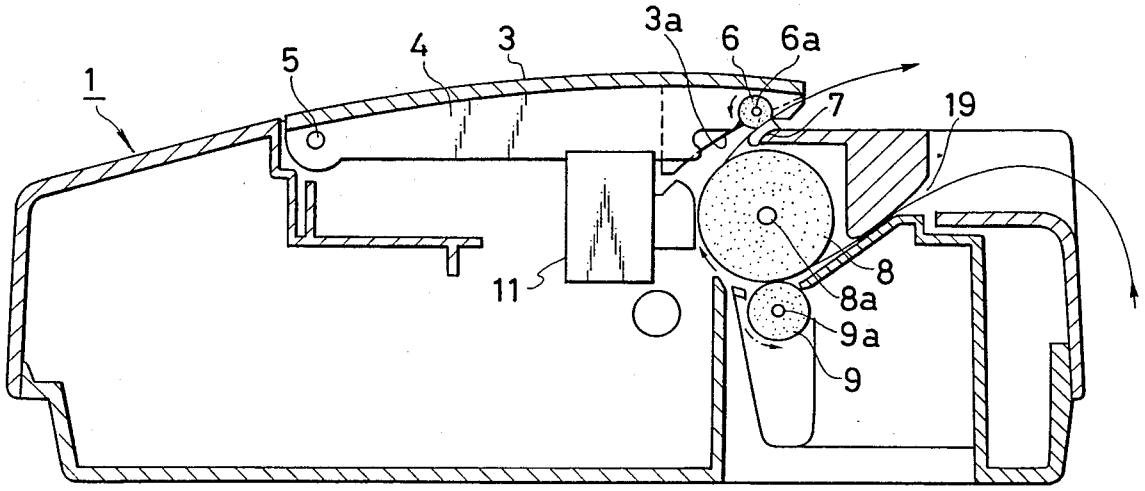
FIG. 3 is a schematic longitudinal sectional view of the printer shown in FIG. 2.
Figure 6:
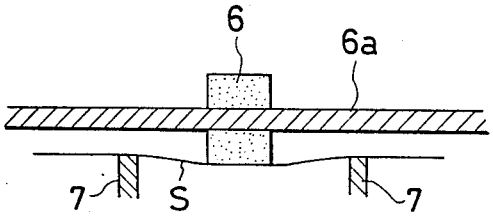
FIG. 6 is a fragmentary schematic transversal sectional view showing a positional relationship between a feed roller, urging members and a printing sheet.

Referring to FIGS. 2 and 3, reference numeral 1 denotes a main unit of the printer having an upper wall formed with a cover receiving portion 2 into which an upper or top cover 3 is adapted to be fitted. The cover 3 has opposite side walls 4 each having one end portion rotatably supported by a shaft 5 which is supported by the printer unit 1, and another end portion supporting a roller support shaft 6a which in turn supports feed rollers (one of which is shown by reference numeral 6) for pulling out the printing sheet toward the downstream side of a sheet feed path of the feeder. The rollers 6 rotate in unison with the support shaft 6a, and are fixed on the shaft 6a at spaced intervals with each located between an associated pair of protrusions or urging members 7 (FIG. 6). The upper cover 3 is integrally formed at its edge portion facing the feed rollers with plural guide members (one of which is shown by reference numeral 3a in FIG. 3) which serve to guide the printing sheet toward the urging members 7. These urging members 7 are formed on a rear upper wall of the printer unit 1 integrally therewith and disposed at a location above the platen 8 and below the guide members 3a. As shown in FIG. 6, the urging members 7 and the feed rollers 6 are positioned to slightly overlap each other in the radial direction of the rollers 6 so that each upper surface of the respective urging members 7 is positioned slightly closer to the roller support shaft 6a than is the outer peripheral surface of the roller 6. Further, friction rollers (one of which is shown by reference numeral 9) are disposed below the platen 8 and in contact with an outer periphery of the platen 8. A rotary shaft 9a of the friction rollers 9 is rotatably supported at opposite ends by one ends of support rods (not shown) each having another end pivotally supported by the printer unit 1, so that the frictional rollers 9 are displaceable toward and away from the platen 8 by manual operation of a roller release lever 10 disposed at the upper face of the printer main unit 1 in a manner projecting outwardly therefrom and operatively connected with the frictional rollers through the support rods.

A printing head 11 is disposed opposite the platen 8 for printing onto a printing sheet. A platen knob 12 is secured to the rotary shaft 8a of the platen 8 for manual rotation of the platen 8.

Figure 4:
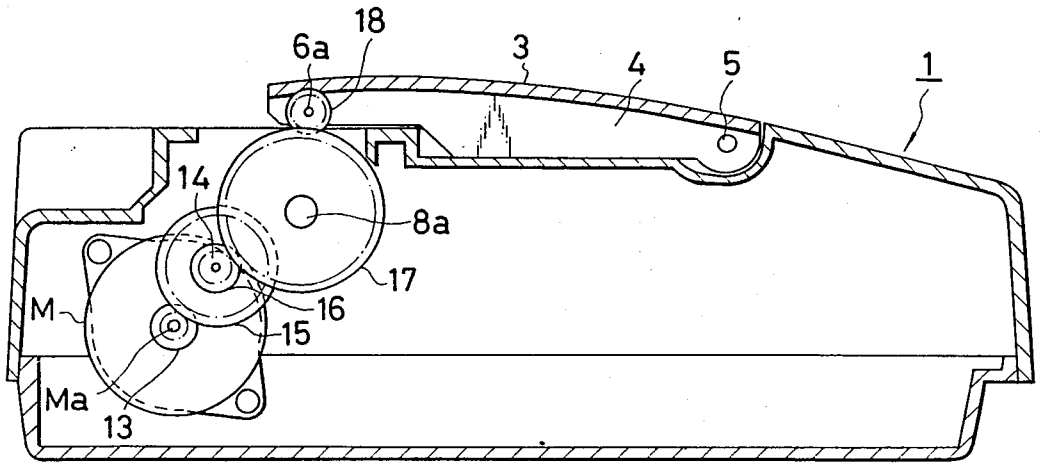
FIG. 4 a view similar to FIG. 3, as viewed from the opposite side to that of FIG. 3.
Figure 5:
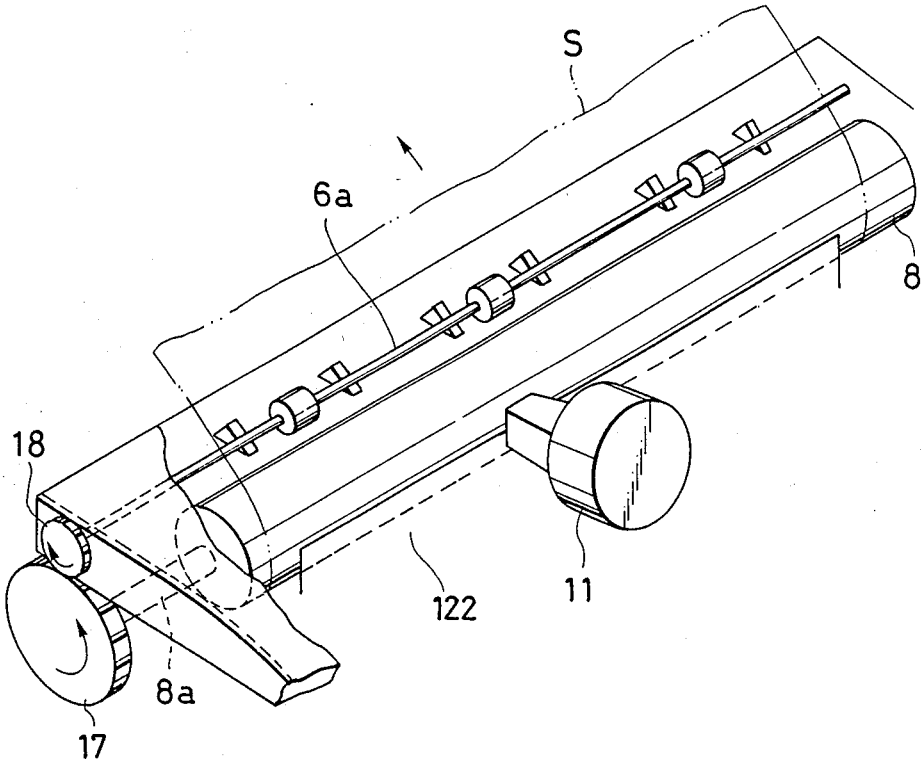
FIG. 5 is a fragmentary perspective view showing a sheet feeder of the printer of FIG. 2, with part thereof broken away.

Referring to FIGS. 4 and 5, a sheet feed motor M having an output shaft Ma is disposed inside the main unit 1 of the printer. A sheet feed gear 13 fastened to the motor shaft Ma is arranged in mesh with a first transmission gear 15 fixed on a shaft 14 which is rotatably supported by the printer unit 1, and a second transmission gear 16 fixed on the same shaft 14 is disposed in mesh with a platen gear 17 secured on the rotary shaft 8a of the platen 8, and further a roller gear 18 is fastened to the support shaft 6a of the feed rollers in disconnectable mesh with the platen gear 7. In this manner, the platen 8 and the feed rollers 6 are operatively connected to the motor M through these gears 13–18, and the friction rollers 9 are disconnectably abutted to the platen 8 to be rotatable in unison with the platen 8.

Within printer unit 1 there is a sheet supply path 19 forming part of the sheet feed path defined so that the printing sheet is delivered therealong with rotation of the platen 8 to a printing area on the platen where printing is effected with the printing head 11; the sheet is then delivered by the feed rollers 6 outside of the printer unit 1.

Figure 7:
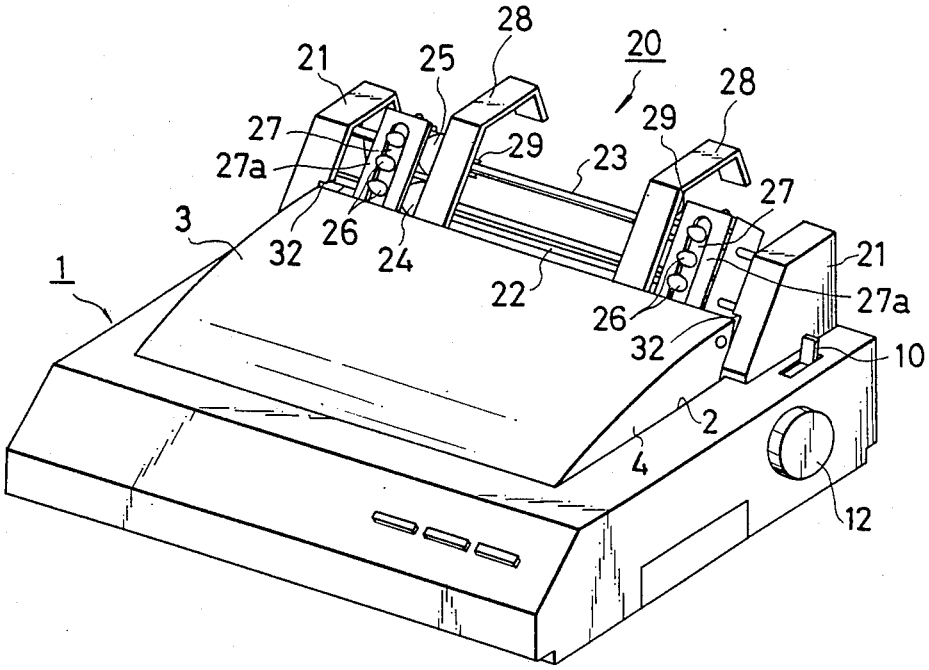
FIG. 7 is a schematic perspective view showing the printer of FIG. 2 with a tractor unit mounted thereon.

FIGS. 7 though 9 show a printer main unit according to the present embodiment, with a tractor unit for feeding the continuous form sheet detachably mounted thereon.

Figure 8:
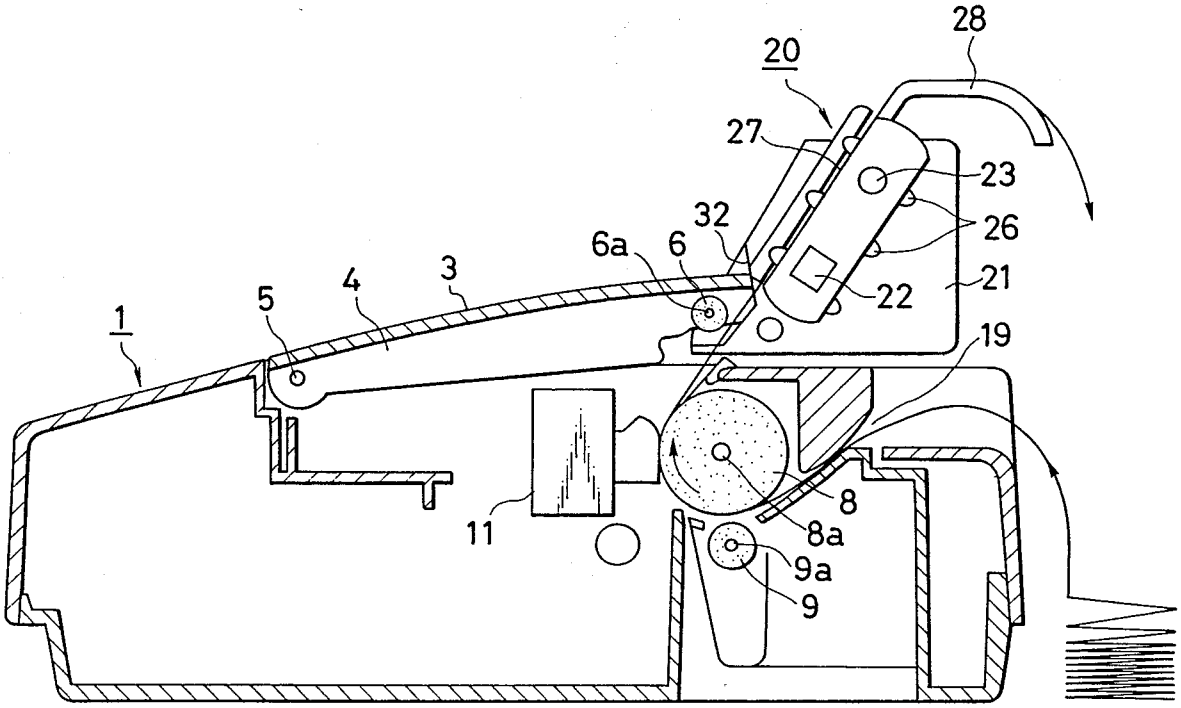
FIG. 8 is a schematic longitudinal sectional view of the printer of FIG. 7.
Figure 9:
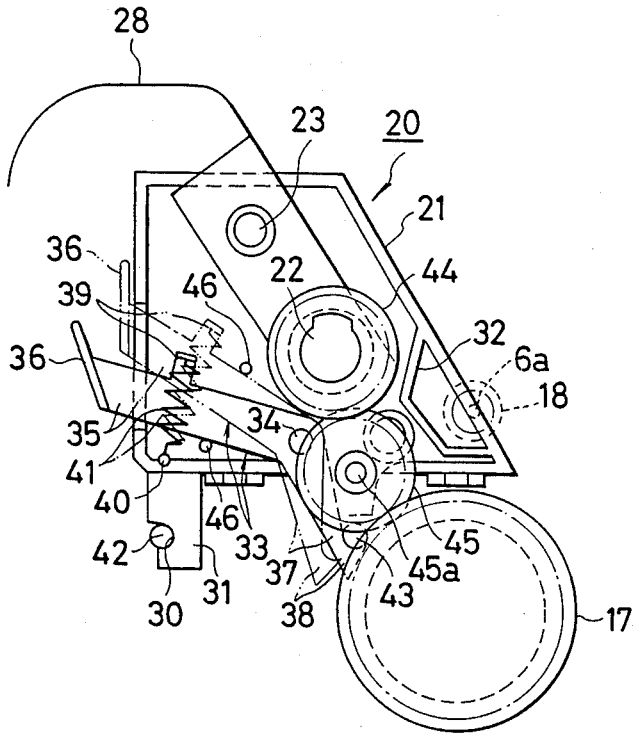
FIG. 9 is a schematic fragmentary side view of the tractor unit shown in FIGS. 7 and 8.

As shown in FIGS. 8 and 9, the tractor unit 20 is arranged to be detachably mounted on the upper face of the printer unit 1 at the side facing the platen 8, and comprises box-like support members 21 for mounting the tractor unit 20 onto the printer unit 1, these support members 21 forming opposite side portions of the tractor unit 20 and each having an open inner side face. A drive shaft 22 is rotatably supported between these support members 21, and a support shaft 23 is rotatably supported at a location above the drive shaft 22. Further, transfer belts 27 are looped between driving pulleys 24 fastened to opposite end portions of the drive shaft 22, and driven pulleys 25 respectively secured on opposite end portions of the support shaft 23. The distance between these belts 27 is adjustable in accordance with the width of the sheet. The belt 27 is formed with a plurality of protrusions 26 for engagement with guide holes formed in the continuous form type sheet at opposite side edge portions of the sheet, the protrusions being separated from each other in a direction along which the belt extends. Reference numeral 27a designates sheet hold plates for holding a printed portion of the continuous form sheet therebetween with the belt 27. Each of the plates 27a is formed with an elongated hole through which the protrusions 26 project outwardly. Reference numeral 28 denotes a separator for guiding the printed portion of the continuous form sheet outside of the printer unit 1, which separator is supported by the support shaft 23 through a mounting tip member 29.

As shown in FIG. 9, the support members 21 each have a bottom wall integrally formed with a depending mounting plate 31 engageable with an associated one of mounting holes 1*a* (FIG. 2) formed in the rear upper wall of the printer unit 1. Each of these plates 31 is formed at one side edge with a notch 30 which is adapted to engage with an associated positioning pin 42 disposed within the interior of the printer unit 1. Further, the support member 21 has an oblique front wall formed at its inner lower portion with a recess 32 which is adapted to engage with one end of the upper cover 3 at the side facing the rollers 6.

Disposed within the internal space of the support member 21 is an L-shaped tractor lever 33 which consists of a first lever portion 35 and a second lever portion 37, and is rotatably supported at its central bent portion by a support shaft 34. The first lever portion 35 has its outer end projecting outwardly of the rear wall of the support member 21 and is formed with an operating portion 36, and an intermediate portion having a protuberance 39. An engaging spring 41 is interposed between the protuberance 39 of the lever 33 and a pin 40 fixed to an inner face of the bottom wall of the support member 21, to urge the tractor lever 33 in a counterclockwise direction. The second lever portion 37 of the lever 33 is formed at its outer end with a hook pawl which is adapted to engage with a support pin 43 disposed within the printer unit 1.

Reference numeral 44 denotes a tractor gear fastened to the drive shaft 22, with which gear an idle gear 45 is engaged. The idle gear 45 is fastened to a support shaft 45*a* rotatably supported by the support members 21, and is in mesh with a platen gear 17. Reference numerals 46 designate engaging pins for limiting upper and lower angular positions of the tractor lever 33.

In the following, a mounting operation of the tractor unit 20 onto the main unit 1 of the printer will be explained. First, the upper cover 3 is pivoted by the user around the shaft 5 in a counter-clockwise direction so as to be displaced upwardly of the upper face of the printer unit 1. Thereafter, when the mounting plates 31 of the tractor unit 20 are inserted into the mounting holes 1*a* formed on the upper face of the printer unit 1, respectively, with the notches 30 of the plates 31 brought into engagement with the positioning pin 42 in the printer unit 1, the lever 33 is guided at one side of its second lever portion 37 by the supporting pin 43 and is pivoted in a clockwise direction by the same pin 43. Upon seating the support members 21 onto the upper face of the printer unit 1, the hook pawl 38 of the tractor lever 33 is caused to be engaged with the supporting pin 43 as shown by the solid line in FIG. 9, and thus the tractor unit 20 is positively held at such seating state by the tension spring 41 urging the lever in a counterclockwise direction.

On the other hand, when the user wishes to disconnect the tractor unit 20 from the printer unit 1, he causes the tractor lever 33 to pivot in a clockwise direction against the spring force of the spring 41, so as to disconnect the hook pawl 38 from the support pin 43 as shown by the chain line in FIG. 9, and then lifts the unit 20 upward, to complete disconnection of the unit 20 from the printer unit 1.

Next, with reference to FIGS. 2 through 5, the operation of the printer in the case of feeding the cut form sheet will be explained. The user first actuates the feed motor M (the tractor unit 20 is disconnected from the printer unit 1). With rotation of the output shaft Ma of the motor M, the sheet feed gear 13 is rotated, the rotation of which is transmitted throught the first and second transmission gears 15, 16 to the platen gear 17, which in turn causes the rotation of the roller gear 18. Upon supply of the cut form sheet through the sheet supply path 19, the sheet is delivered by the rotating platen 8 and the friction rollers 9 which are rotated by the rotating platen, and then printing onto the sheet supported by the platen 8 therearound is carried out by the printing head 11. Thereafter, the sheet is directed to the urging members 7 formed on the upper wall of the printer unit 1. Due to the above-mentioned overlapped arrangement of the feed rollers 6 and the urging members 7, the sheet having some rigidity and resiliency is tightened at its portions between the respective pairs of the urging members 7, and is brought into urged contact with the outer periphery of the rollers 6. At this time, the sheet is guided by the guiding members 3*a* formed on the cover 3, so that the leading end of the sheet easily reaches onto the upper surfaces of the respective urging members 7 through a gap between the platen 8 and the rollers 6 separated therefrom, and is then automatically inserted between the members 7 and the rollers 6 with rotation of these rollers. As a result, the sheet is brought into frictional engagement with the feed rollers 6 which are rotated by the rotating platen gear 17 through the gear 18, to be positively delivered outside of the printer unit 1 until after the sheet has reached such a position that the trailing end thereof is disconnected from a portion of the sheet feed path defined between the platen 8 and the friction rollers 9, without occurrence of inclination of the sheet with respect to a normal sheet feeding direction, and fluctuation in the feeding rate of the sheet.

Next, with reference to FIGS. 7 through 9, an explanation will be given as to the case where a printing sheet of continuous form is employed. The user operates the roller release lever 10 so as to disconnect the friction rollers 9 from the platen 8, and then lifts the upper cover 3 away from the printer unit 1. Thereafter, the tractor unit 20 is mounted onto the printer unit 1, with the engaging portion or recess 32 of the support members 21 of the unit 20 abutted to or engaged with the associated end portion of the upper cover 3 at the side facing the feed rollers 6. As a result, the rollers 6 are displaced away from the sheet feed path (FIG. 9) and the roller gear 18 is moved together with the rollers 6 to be disengaged from the platen gear 17. Then, the sheet of continuous form is supplied or set manually through the sheet supply path 19 up to the tractor unit 20, and the guide holes formed in the sheet are fitted on the associated protrusions 26 formed in the transfer belt 27, respectively. Upon actuation of the feed motor M, the platen gear 17 and the tractor gear 44, which is operatively connected through the idle gear 45 with the platen gear 17, are rotated. With rotation of the gear 44, the drive shaft 22 and the drive pulleys 25 rotatable in unison therewith are rotated to cause the rotation of the transfer belt 27 looped between these pulleys 24, 25. As a result, the sheet is delivered with rotation of the belt 27, and then printing onto the sheet supported by the platen 8 therealong is effected by the printing head 11. Thereafter, the sheet is further delivered outside of the printer unit 1. At that time, the feed rollers 6 mounted on the upper cover 3 never prevent the transfer operation of the tractor unit 20. Further, since a gap between the upper cover 8 and the tractor unit 20 is considerably small, noise generated by operation of the printer is prevented from leaking outside of the printer therethrough.

In the above-mentioned embodiment, the printer consists of the printer main unit 1 and the tractor unit 20 detachably mounted thereon, so that both of the cut form sheet and the continuous sheet can be selectively used. However, the present invention is not limited thereto. For instance, the printer may be constructed only by the above-mentioned printer unit 1 for delivery of the cut form sheet alone. Since such printer can be constructed in substantially the same manner as that of the above-mentioned printer unit and the operation thereof will be apparent from the foregoing descriptions, a detailed explanation will be omitted.

What is claimed is:

1. A sheet feeder for use in a printer having a main unit including a printing section said sheet feeder having a platen disposed at a location opposite said printing section and adapted to be rotatively driven, comprising at least one feed roller and means for rotatably supporting the feed roller on the printer, coupling means for operatively coupling said at least one feed roller to said platen for drivingly rotating said feed roller positioned in a working location in response to rotation of the platen, said at least one feed roller at said working location being spaced out of contact from said platen so as to avoid pinching the sheet between said at least one feed roller and said platen; and at least one urging means for engaging a printing sheet with said at least one feed roller in the working location, said at least one urging means comprising a pair of urging portions respectively disposed at opposite sides of a corresponding one of said at least one feed roller in an axially spaced direction of said corresponding one feed roller, and overlapping with said corresponding one feed roller in a direction radially thereof for urging the printing sheet so as to engage the printing sheet with said corresponding at least one feed roller each of said urging portions comprising a ramp-like static guide means;

whereby the printing sheet is smoothly settable on the platen;

said supporting means being operable to move said at least one feed roller between said working location and an inoperative location on said printer, further comprising said supporting means being operable to release the drive coupling between said at least one feed roller and said platen through said coupling means in the inoperative location, a removably mounted tractor unit including means for detachably mounting said tractor unit on said main unit, the detachable mounting means including an engaging portion, wherein said at least one feed roller in said inoperative location enables said tractor unit to be mounted on said main unit of said printed by allowing the engaging portion to detachably engage said main unit for feeding a printing sheet of continuous form to said tractor unit.

2. A sheet feeder according to claim 1, wherein said platen has an axis, a plurality of said feed rollers being disposed at spaced intervals along and in parallel with the axis of said platen.

3. A sheet feeder according to claim 1, further comprising: at least one friction roller disposed in a sheet feed path of said sheet feeder upstream from said printing section in a selectively rotatable manner with said platen, wherein said at least one feed roller is disposed in the sheet feed path downstream from said printing section.

4. A sheet feeder according to claim 1, wherein said supporting means includes a cover adapted to be disconnectably fitted into a cover receiving portion formed in an outer wall of said main unit of said printer, said at least one feed roller being fastened to a roller shaft for rotation therewith, said roller shaft being rotatably supported by said cover at an end portion thereof facing said platen, said platen including a platen shaft extending axially of said platen, said coupling means including said platen shaft, said roller shaft, a first gear fastened to said roller shaft for rotation therewith, and a second gear fastened to said platen shaft for rotation therewith and in mesh with said first gear, said cover being engageable with a part of said engaging portion formed on an outer wall of said tractor unit upon mounting said tractor unit on said main unit so that said cover and said feed roller held at the inoperative location wherein engagement between said first gear and said second gear is released, said cover and feed roller assuming said working location where said first gear and said second gear are engaged with each other upon disconnecting said tractor unit from said main unit.

5. A sheet feeder according to claim 1, further comprising: at least one friction roller disposed in selective urged contact with said platen, and a roller release lever operatively coupled to said at least one friction roller and operable to disconnect said friction roller from said platen.

6. A sheet feeder for use in a printer having a main unit including a printing section said sheet feeder having a platen disposed at a location opposite said printing section and adapted to be rotatively driven, comprising at least one feed roller and means for rotatably supporting the feed roller on the printer, coupling means for operatively coupling said at least one feed roller to said platen for drivingly rotating said feed roller positioned in a working location in response to rotation of the platen, said at least one feed roller at said working location being spaced out of contact from said platen so as to avoid pinching the sheet between said at least one feed roller and said platen; and at least one urging means for engaging a printing sheet with said at least one feed roller in the working location, said at least one urging means comprising a pair of urging portions respectively disposed at opposite sides of a corresponding one of said at least one feed roller in an axially spaced direction of said corresponding one feed roller, and overlapping with said corresponding one feed roller in a direction radially thereof for urging the printing sheet so as to engage the printing sheet with said corresponding at least one feed roller each of said urging portions comprising a ramp-like static guide means;

whereby the printing sheet is smoothly settable on the platen;

said supporting means being operable to move said at least one feed roller between said working location and an inoperative location on said printer wherein said main unit has an outer wall thereof formed with a cover receiving portion, said supporting means includes a cover member being disengageably connected into said cover receiving portion, said at least one feed roller being rotatably supported by said cover member, said urging portions being formed on the outer wall of said main unit of said printer at a location facing said platen.

7. A sheet feeder according to claim 6, wherein said cover member is formed with guide means for guiding the printing sheet toward said urging portions, the urging portions being of unitary construction with the outer wall.

8. A sheet feeder according to claim 6, wherein said platen has a platen shaft extending axially thereof, said at least one feed roller having a roller shaft extending axially thereof and rotatable in unison therewith, said coupling means including said platen shaft, said roller shaft, a first gear fastened to said roller shaft and rotatable in unison therewith, a second gear being fastened to said platen shaft in a manner rotatable in unison therewith and in mesh with said first gear.

* * * * *